US006857966B2

(12) United States Patent
Armbruster et al.

(10) Patent No.: US 6,857,966 B2
(45) Date of Patent: Feb. 22, 2005

(54) COLLAPSIBLE INFANT SWING

(75) Inventors: Michael D. Armbruster, Buffalo, NY (US); John S. Canna, Orchard Park, NY (US); Michael T. Kane, Conesus, NY (US); Robert Sonner, South Wales, NY (US)

(73) Assignee: Fisher-Price, Inc., East Aurora, NY (US)

( * ) Notice: Subject to any disclaimer, the term of this patent is extended or adjusted under 35 U.S.C. 154(b) by 0 days.

(21) Appl. No.: 10/774,407

(22) Filed: Feb. 10, 2004

(65) Prior Publication Data

US 2004/0198514 A1 Oct. 7, 2004

Related U.S. Application Data

(63) Continuation of application No. 10/366,558, filed on Feb. 14, 2003, now Pat. No. 6,824,472, which is a continuation of application No. 09/968,498, filed on Oct. 2, 2001, now Pat. No. 6,520,862.

(51) Int. Cl.[7] ..... A63G 9/12

(52) U.S. Cl. ..... 472/118; 472/119

(58) Field of Search ..... 472/118–125; 297/273

(56) References Cited

U.S. PATENT DOCUMENTS

| | | | | |
|---|---|---|---|---|
| 137,121 | A | 3/1873 | Alcorn | |
| 146,069 | A | 12/1873 | Harris | |
| 237,820 | A | 2/1881 | Clark | |
| 433,649 | A | 8/1890 | Elias | |
| 594,015 | A | 11/1897 | Homer | |
| 785,201 | A | 3/1905 | Crandall | |
| 803,838 | A | 11/1905 | Mellen | |
| 955,841 | A | 4/1910 | Benner | |
| 1,262,927 | A | 4/1918 | Derhammer | |
| 1,266,927 | A | 5/1918 | Eberle | |
| 1,418,318 | A | 6/1922 | Merifield | |
| 1,439,619 | A | 12/1922 | Dziedzic | |
| 1,458,049 | A | 6/1923 | Grieshaber | |
| 1,462,657 | A | 7/1923 | Rainalter | |
| 1,574,672 | A | 2/1926 | McCarroll-Doull | |
| 1,577,320 | A * | 3/1926 | Korzeniewski | 297/273 |
| 2,398,384 | A | 4/1946 | Meyers | |
| 2,478,445 | A | 8/1949 | Yurkovich | |
| 2,517,207 | A | 8/1950 | Hugueny | |

(List continued on next page.)

FOREIGN PATENT DOCUMENTS

| | | |
|---|---|---|
| DE | 33 34 229 A1 | 4/1985 |
| DE | 86 01 798 U | 9/1986 |
| EP | 0 758 536 A1 | 2/1997 |
| GB | 137956 | 1/1920 |
| GB | 1070921 | 6/1967 |

OTHER PUBLICATIONS

Product advertisement for Kolcraft's "Lil' Swinger" infant swing, 1 page.

Product advertisement for Graco's "Advantage" baby swing, 2 pages.

Product advertisement for Buckle–Up–Buddie, 1986, 4 pages.

Safety 1st 2–in–1 Bouncenette Owner's Guide, pp. 1–4, 2000.

*Primary Examiner*—K. T. Nguyen
(74) *Attorney, Agent, or Firm*—Cooley Godward LLP

(57) ABSTRACT

The present invention provides an infant swing frame having a base, and first and second support posts. Each of the support posts is pivotally coupled at a first end thereof to the base, and each of the support posts has a second end. A cross member is coupled between the support posts. The support posts and the base are reconfigurable between a first position in which the support posts are angularly spaced from the base and a second position in which the support posts are adjacent the base.

6 Claims, 10 Drawing Sheets

U.S. PATENT DOCUMENTS 2,524,967 A 10/1950 Ellis
2,638,966 A 5/1953 Wardlaw
2,708,960 A 5/1955 Shephard
2,988,136 A 6/1961 Kowalczyk
3,004,793 A 10/1961 Loomis
3,146,985 A 9/1964 Grudoski
3,256,016 A * 6/1966 Berlin ..... 472/118
3,701,071 A 10/1972 Landman
D229,130 S 11/1973 Foster
3,779,124 A 12/1973 Christensen
3,806,117 A 4/1974 Foster
3,837,019 A 9/1974 Hoff
3,842,450 A 10/1974 Pad
4,022,510 A 5/1977 Saint
4,065,175 A 12/1977 Perego
D248,518 S 7/1978 Huff
D250,861 S 1/1979 Boudreau et al.
4,150,820 A 4/1979 Bochmann
4,165,872 A 8/1979 Saint
4,181,299 A 1/1980 Foster
D254,409 S 3/1980 Borucki
4,240,625 A 12/1980 Meeker
4,271,627 A 6/1981 Echterling
4,323,233 A 4/1982 Gebhard
4,324,432 A 4/1982 Eldon, III et al.
4,325,578 A 4/1982 Borucki
4,377,011 A 3/1983 Kinberger
4,415,200 A 11/1983 Bourne
4,452,446 A 6/1984 Saint
4,491,317 A 1/1985 Bansal
4,551,114 A 11/1985 Hyman et al.
4,589,657 A 5/1986 Saint
4,595,618 A 6/1986 Caringer
4,616,824 A 10/1986 Quinlan, Jr. et al.
4,620,702 A 11/1986 Hemmeter
4,693,512 A 9/1987 Hobson
4,697,845 A 10/1987 Kamman
D293,046 S 12/1987 Riehm
4,761,032 A * 8/1988 Sanchez et al. ..... 297/229
4,783,863 A 11/1988 Degen
4,785,678 A 11/1988 McGugan et al.
4,807,872 A 2/1989 Spilman et al.
4,822,033 A 4/1989 Kohus et al.
4,867,464 A 9/1989 Cook
4,881,285 A 11/1989 Zeeb
D305,584 S 1/1990 Spilman et al.
4,940,229 A 7/1990 Foster
4,948,120 A 8/1990 Krueger
4,973,106 A 11/1990 Strovinskas
5,005,866 A 4/1991 Reedom
5,016,915 A 5/1991 Perry
D323,363 S 1/1992 Ely
5,083,773 A 1/1992 Saint
5,083,837 A 1/1992 Roach
5,113,537 A 5/1992 Turk
5,207,478 A 5/1993 Freese et al.
5,221,225 A 6/1993 Newbold et al.
5,238,291 A 8/1993 Alionis
5,269,587 A 12/1993 Cunningham et al.
5,269,591 A 12/1993 Miga, Jr. et al.
D347,102 S 5/1994 Strasner
5,308,143 A 5/1994 Cheng et al.
D348,157 S 6/1994 Amburgey et al.
5,326,327 A 7/1994 Stephens et al.
D349,819 S 8/1994 Noll
5,348,374 A 9/1994 Kuo
D351,289 S 10/1994 Stephens et al.
5,376,053 A 12/1994 Ponder et al.
5,378,196 A 1/1995 Pinch et al.
D358,494 S 5/1995 Baerenwald et al.
5,413,399 A 5/1995 Myers et al.
5,451,095 A 9/1995 Riback
5,464,381 A 11/1995 Wilson
5,478,268 A 12/1995 Au
D368,816 S 4/1996 Mitchell et al.
5,507,564 A 4/1996 Huang
5,509,721 A 4/1996 Huang
5,522,639 A * 6/1996 Jaime ..... 297/184.13
5,525,113 A 6/1996 Mitchell et al.
5,531,656 A 7/1996 Varghese
5,533,936 A 7/1996 Julien et al.
5,542,151 A 8/1996 Stranski et al.
D374,353 S 10/1996 Coleman
5,562,548 A 10/1996 Pinch et al.
5,564,987 A * 10/1996 Ayrolles ..... 472/118
5,605,409 A 2/1997 Haut et al.
5,617,594 A 4/1997 Chien
5,628,689 A 5/1997 Saint et al.
5,662,380 A 9/1997 Tam et al.
5,707,294 A 1/1998 Fischer
5,708,994 A 1/1998 Chandran
D392,126 S 3/1998 Sack
5,730,490 A 3/1998 Mortenson
5,738,410 A 4/1998 Stroud et al.
5,769,727 A 6/1998 Fair et al.
5,791,999 A 8/1998 Lauro et al.
5,803,817 A 9/1998 Stern
5,806,924 A 9/1998 Gonas
5,833,545 A 11/1998 Pinch et al.
5,846,136 A 12/1998 Wu
5,855,031 A 1/1999 Swift, Jr.
5,868,459 A 2/1999 Welsh, Jr.
5,887,945 A 3/1999 Sedlack
5,938,216 A 8/1999 Weng
5,947,552 A 9/1999 Wilkins et al.
5,951,102 A 9/1999 Poulson et al.
5,957,780 A * 9/1999 Grazioli ..... 472/118
5,975,631 A 11/1999 Fair et al.
5,984,791 A 11/1999 Fair et al.
5,988,742 A * 11/1999 Stevens ..... 297/219.12
D418,275 S 1/2000 Contreras
6,010,410 A 1/2000 Lauro et al.
6,017,007 A 1/2000 Muzzi
6,019,427 A 2/2000 Combest
6,022,277 A 2/2000 Jankowski
6,024,648 A 2/2000 Shurtleff et al.
6,027,409 A 2/2000 Favorito et al.
6,059,667 A 5/2000 Pinch
6,062,589 A * 5/2000 Cheng ..... 280/647
6,068,285 A 5/2000 Jackson et al.
6,113,454 A 9/2000 Mitchell
6,126,233 A 10/2000 Gaetano et al.
6,135,487 A 10/2000 Flannery et al.
6,142,575 A 11/2000 Patterson
6,178,978 B1 1/2001 Rieber
6,319,138 B1 * 11/2001 Fair et al. ..... 472/119
6,386,986 B1 * 5/2002 Sonner et al. ..... 472/119
6,464,594 B1 * 10/2002 Canna et al. ..... 472/119
6,471,597 B1 * 10/2002 Flannery et al. ..... 472/119
6,500,072 B1 * 12/2002 Myers et al. ..... 472/119
6,561,915 B2 * 5/2003 Kelly et al. ..... 472/119
6,594,840 B2 7/2003 Tomas et al.
2002/0002741 A1 1/2002 Tomas et al.

* cited by examiner

COLLAPSIBLE INFANT SWING

CROSS REFERENCE TO RELATED APPLICATIONS

This application is a Continuation of U.S. application Ser. No. 10/366,558, filed Feb. 14, 2003, now U.S. Pat. No. 6,824,472 which is a Continuation of U.S. application Ser. No. 09/968,498, filed Oct. 2, 2001, now U.S. Pat. No. 6,520,862, the entire content of each of which is hereby incorporated by reference.

BACKGROUND

1. Field of the Invention

The present invention relates generally to infant swings and more particularly to a collapsible infant swing frame.

2. Discussion of the Related Art

Infant swings are known in the art. Conventional infant swings are designed to be folded or otherwise collapsed for long term storage. However, even in the folded configuration, such swings are still relatively cumbersome and not necessarily compact. Additionally, to fold a conventional swing requires some measure of effort on the part of the user.

There are infant swings that are designed to be easily disassembled and reassembled to make them compact and portable. However, such swings typically require that each of the components of the swing be separated, increasing the likelihood that certain components will be misplaced.

Thus, there is a need for a collapsible infant swing that is easily reconfigured from a stored position to a useful position and that can be easily transported.

SUMMARY OF THE INVENTION

The present invention provides an infant swing frame having a base, and first and second support posts. Each of the support posts is pivotally coupled at a first end thereof to the base, and each of the support posts has a second end. A cross member is coupled between the support posts. The support posts and the base are reconfigurable between a first position in which the support posts are angularly spaced from the base and a second position in which the support posts are adjacent the base.

According to one aspect of the present invention, a pair swing arms are pivotally coupled to the end of a respective support post and extend downwardly from the support posts toward the base when in the first position. A seat is coupled to the lower ends of the swing arms.

These and other aspects of the present invention will become apparent from the following drawings and description.

BRIEF DESCRIPTION OF THE DRAWINGS

The present invention is described with reference to the accompanying drawings. In the drawings, like reference numbers indicate identical or functionally similar elements.

DETAILED DESCRIPTION

Figure 1:
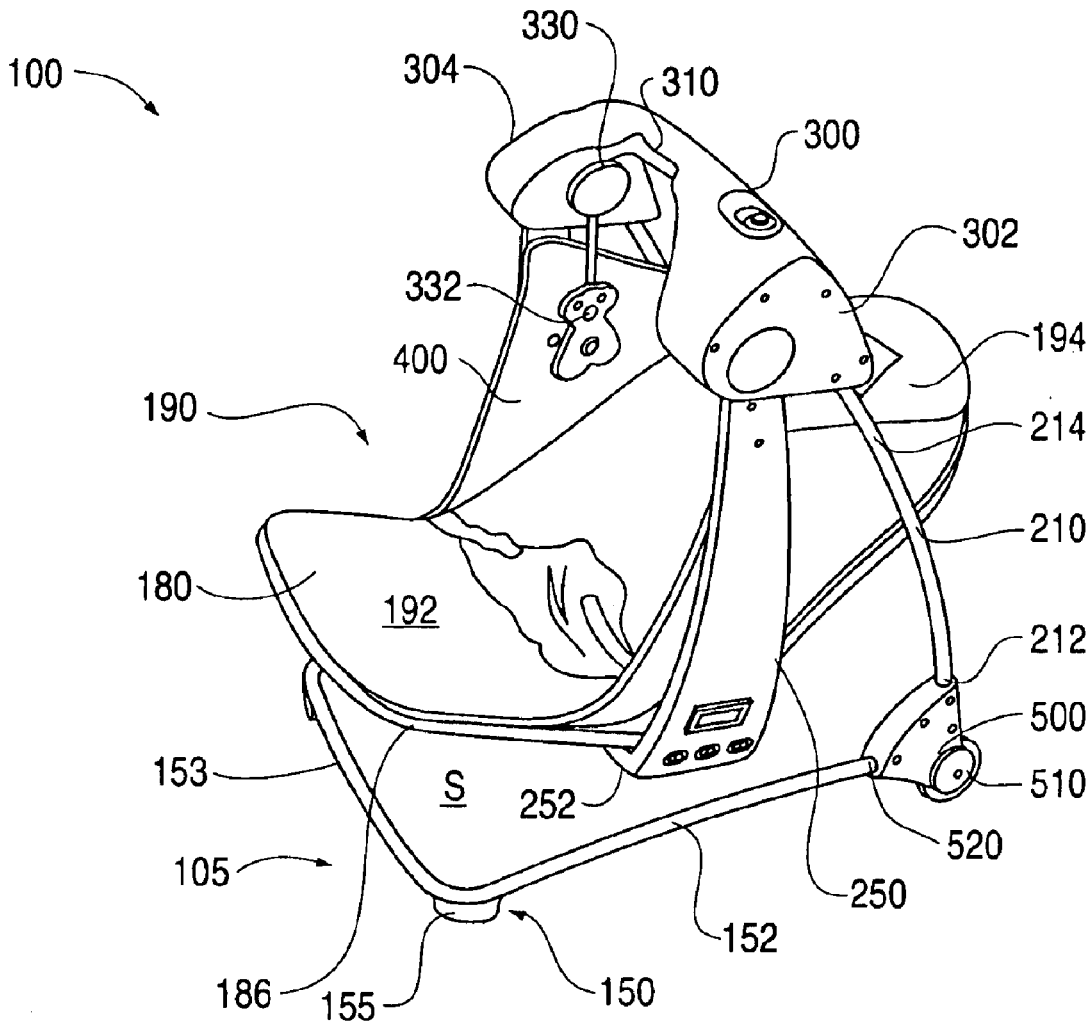
FIG. 1 is a perspective view of one embodiment of the collapsible infant swing embodying the principles of the present invention.
Figure 2:
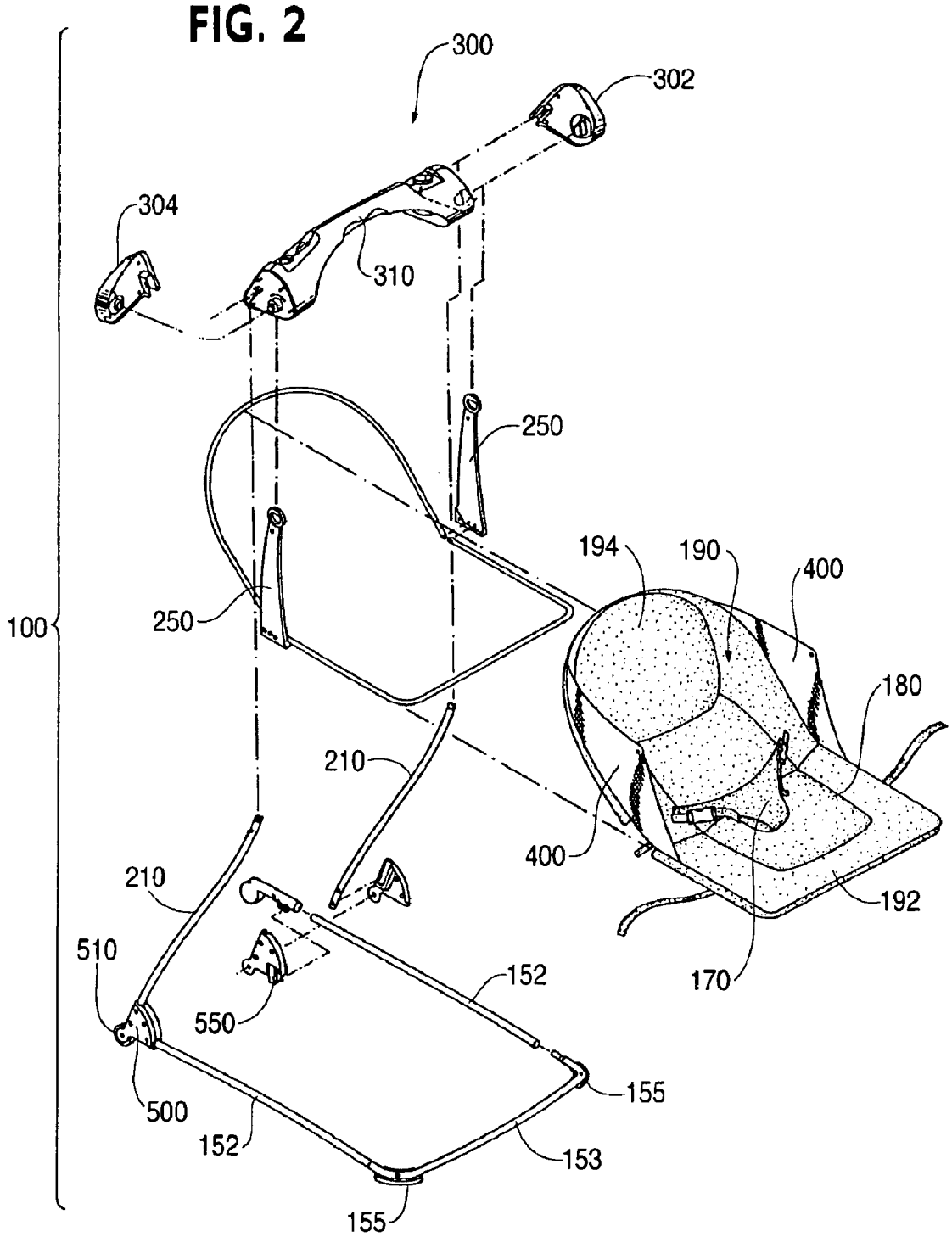
FIG. 2 is an exploded perspective view of the collapsible infant swing illustrated in FIG. 1.
Figure 3:
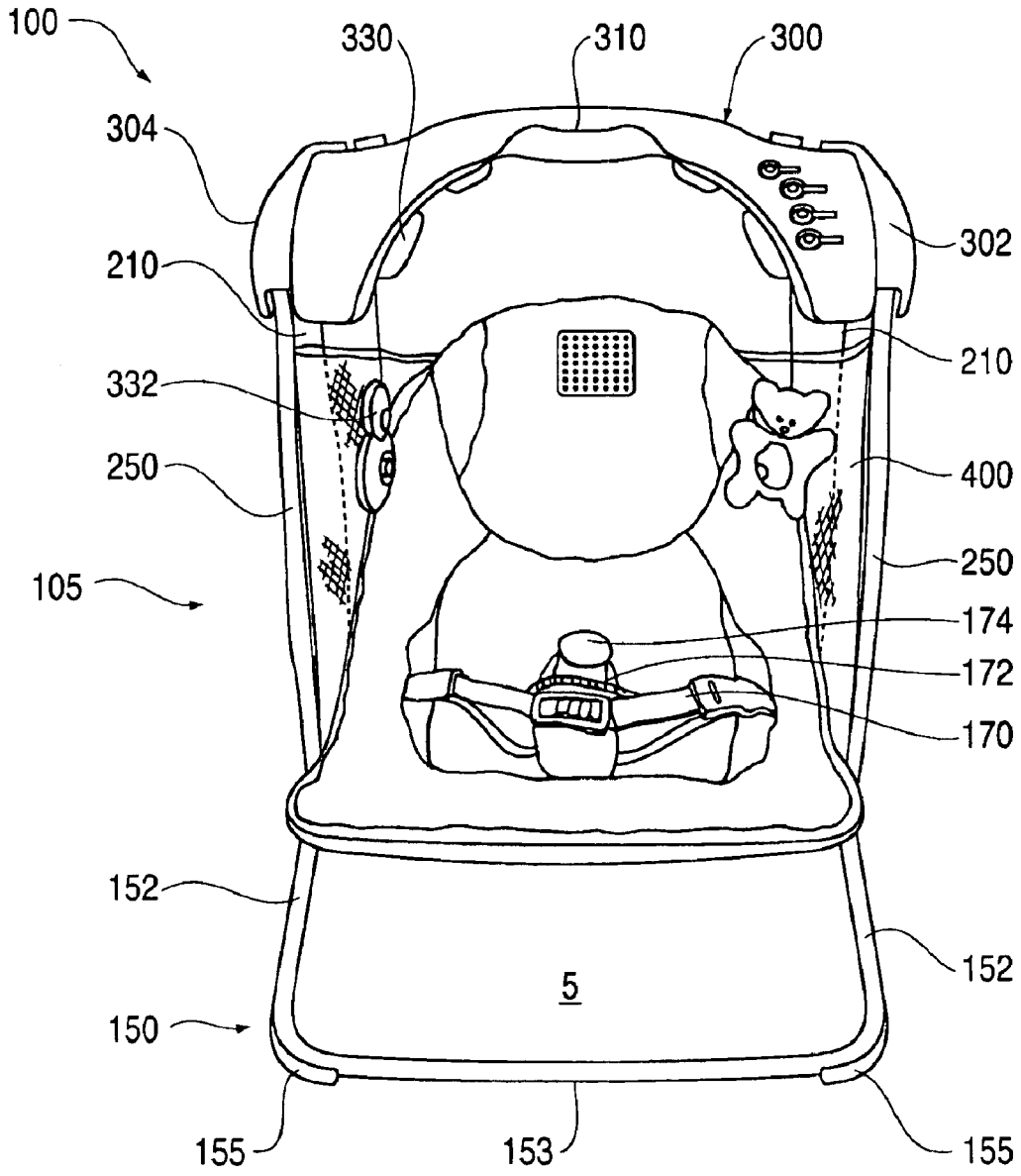
FIG. 3 is a front view of the collapsible infant swing illustrated in FIG. 1.
Figure 4:
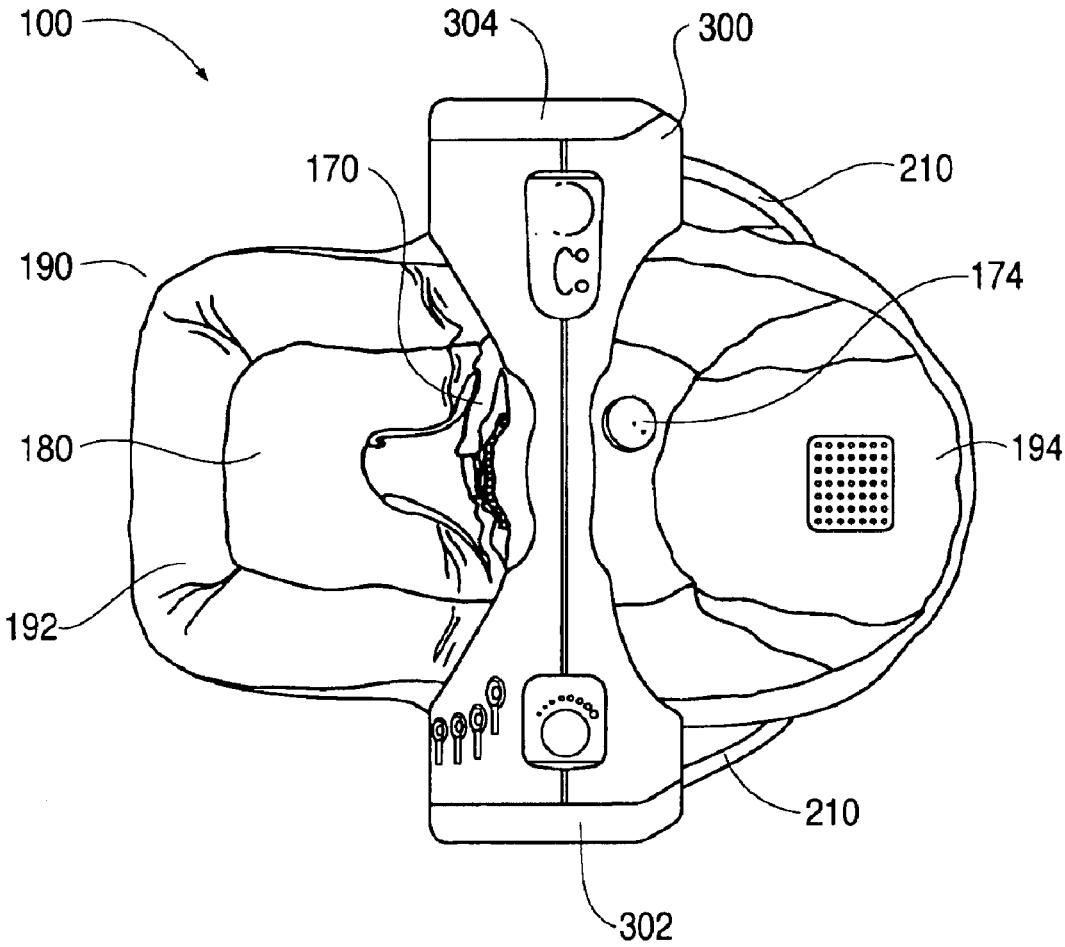
FIG. 4 is a top plan view of the collapsible infant swing illustrated in FIG. 1.

FIGS. 1 through 9 illustrate one embodiment of a collapsible infant swing 100. The collapsible infant swing 100 includes a support frame 105 that supports swing arms 250, which in turn support a swing seat 190.

The support frame 105 is configured to elevate the swing seat 190 above a supporting surface S. Frame 105 includes support posts 210 and a base 150 that are reconfigurable with respect to each other between a first orientation in which the support posts 210 are angularly spaced from the base 150 and a second orientation in which the support posts 210 are adjacent the base 150.

In the illustrated embodiment the base 150 is substantially u-shaped with parallel side members 152 and front member 153. Feet 155 can be provided on the base 150 to engage the supporting surface to inhibit the swing 100 from sliding.

Support posts 210 are coupled to, and extend upwardly from, base 150. Each support post has a first, lower end 212 coupled to the base and a second, upper end 214. The side members 152 and support posts 210 may be coupled to a positioning member 500 (as described in detail below). Alternatively, the support posts 210 may be coupled directly to side members 152.

In the illustrated embodiment, a cross member 300 is coupled between support posts 210 at second end 214 disposed above seat 190. Cross member 300 provides several functions: stability for the frame 100; a handle for carrying the swing; support for the swing seat; a housing for the swing drive system; and a location for entertainment features. In alternative embodiments, cross member 300 can provide subsets of these functions. In the illustrated embodiment, cross member 300 includes a recess 310 sized to permit an adult user to grasp the recess and thus carry swing 100. End caps 302, 304 are included on cross member 300 to maintain the position of the support posts 210 and to maintain the position of swing arms 250 (as described below).

The cross member 300 includes entertainment features such as hanging toys or articles 332 and lights 330. When an infant positioned on the swing seat 190 grasps and/or pulls one of the hanging toys 332, lights and/or sounds may be actuated. The lights and/or sounds may be deactivated after a predetermined time or, alternatively, when the infant grasps or pulls the toy again. Alternatively, lights and sounds may be actuated by the adult user with a switch located on cross member 300.

Swing arms 250 extend downwardly from cross member 300 towards base 150. The swing arms 250 are driven by a drive mechanism (not illustrated) located in cross member 300. Drive assemblies known to those skilled in the art (whether electrical or mechanical) may be used to reciprocate the swing arms 250. A switch is provided on cross member 300 to selectively actuate the drive assembly. The swing arms each have a first, lower end 252 and a second, upper end 254. The second end 254 is coupled within the cross member 300 and may be coupled directly to the second end 214 of support posts 210. The first end 252 of swing arms 250 are coupled to the seat 190.

The seat 190 is substantially elliptical or oval in plan view and includes a removable cover 180 that defines a seating surface between the support posts 210. The seat cover 180 is coupled to a seat frame 186 either by a simple friction fit or using hook-and-loop fasteners. The seat 190 can be manufactured from fabric or similar material. Alternatively, the seat 190 may be manufactured from other flexible materials such as vinyl, molded plastic or the like. Seat 190 may include a quilted surface to provide greater comfort for the infant positioned therein and may be manufactured using multiple layers of fabric between which backing material may be accommodated. The seat includes a foot portion 192 and a back portion 194 that are pivotally coupled to the swing arms 250, so that they may be rotated into a storage position in which they are approximately parallel. The back portion 194 and foot portion 192, together provide a seat that is an inclined position relative to the supporting surface S. Seat 190 further includes a belt 170 to maintain an infant in position in the seat. The belt 170 includes a pocket 172 having a plush article 174 tethered thereto. The pocket provides a convenient storage area for the plush article 174 while the tether allows the infant to play with the article 174 without dropping it on the floor.

Figure 5:
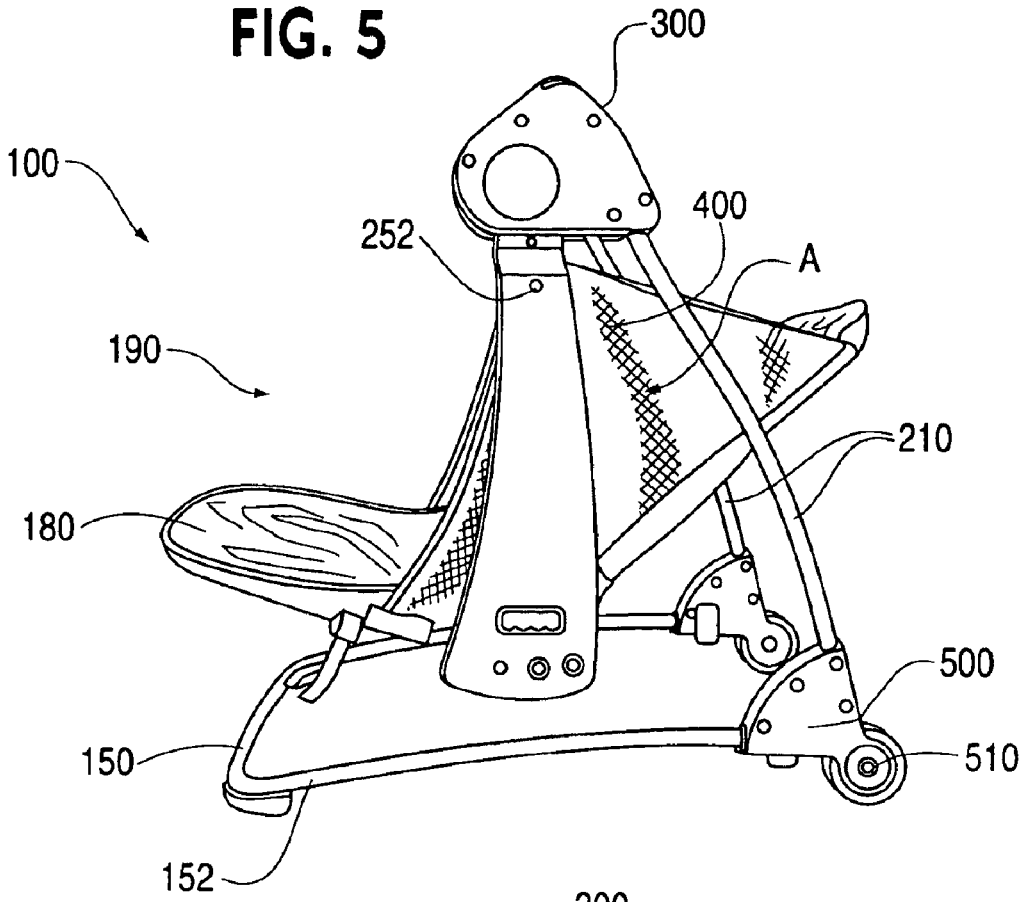
FIGS. 5–7 are side views of the collapsible infant swing illustrated in FIG. 1 at the forward limit of travel, rest position, and rear limit of travel.
Figure 6:
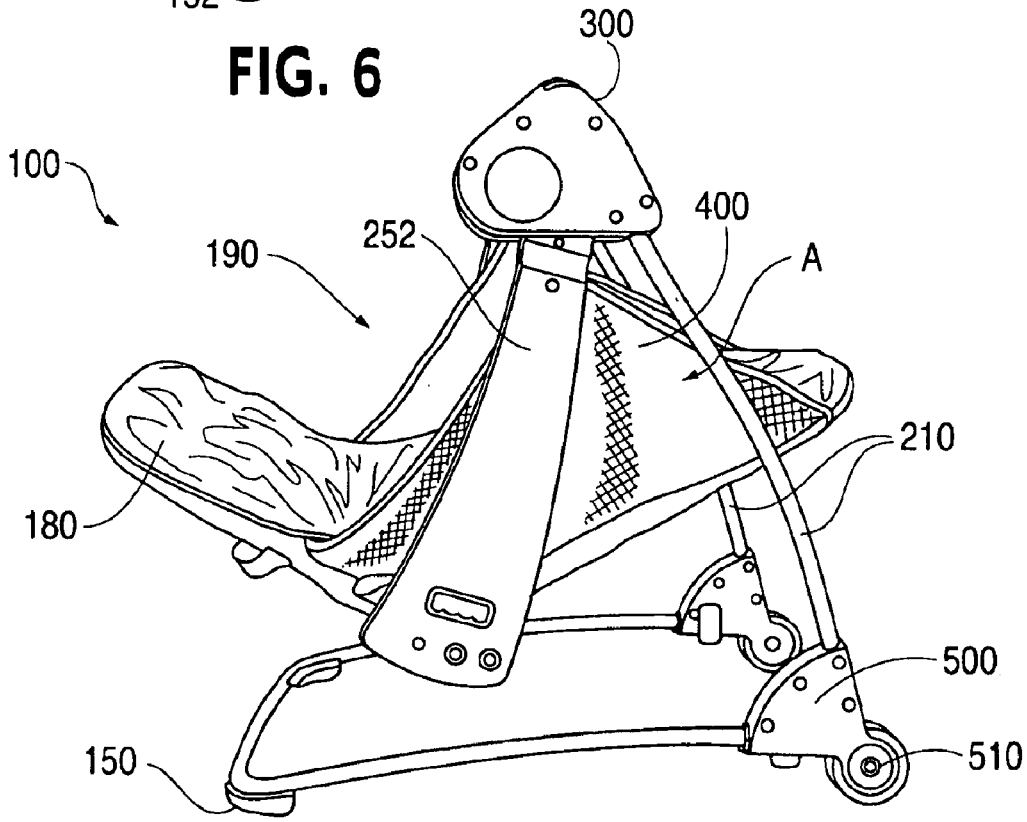
Figure 7:
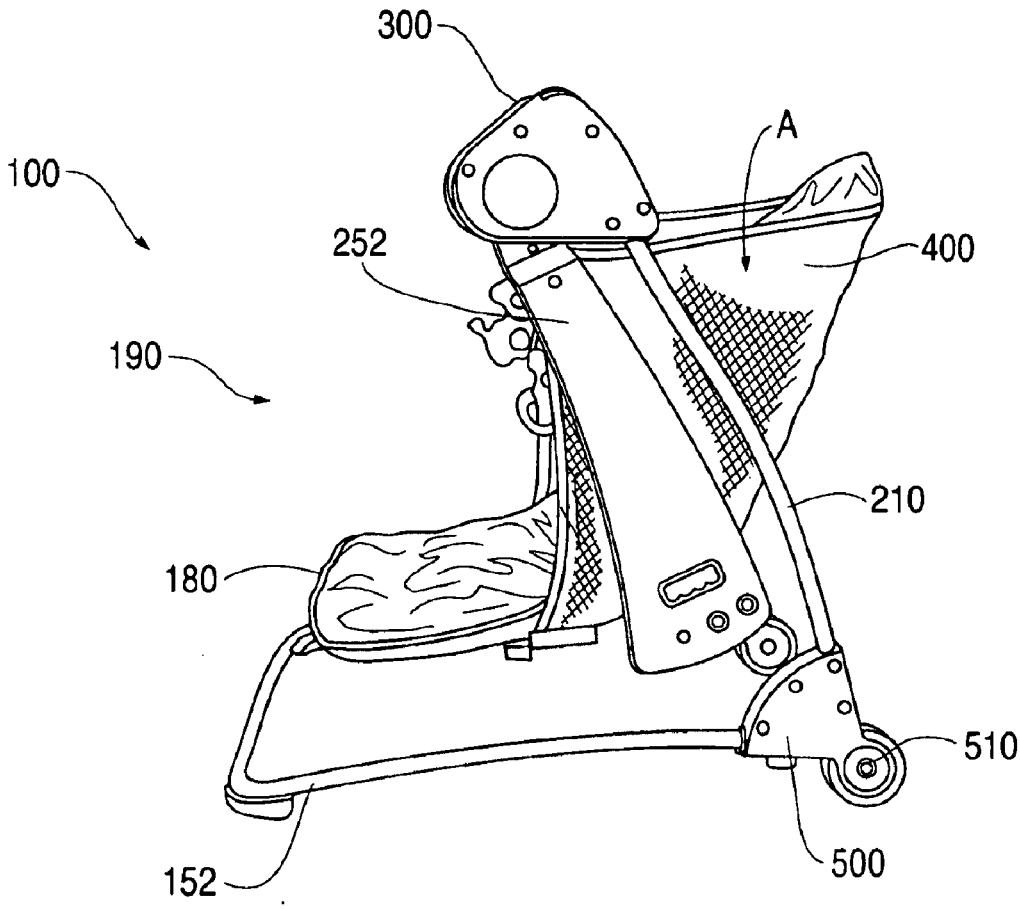

Referring now to FIGS. 5 through 7, the swing 100 further includes a shield 400 coupled to the seat 190 to prevent an infant occupant of the seat from extending its arms outside the seat area. The space between each support post 210 and corresponding swing arm 250 is a wedge-shape swing area A that varies with the position of swing arms 250. FIGS. 5, 6, and 7 illustrate the changing extent of swing area A when the swing is in its rest position at the bottom of the arc defining its range of motion, at the forward end of the arc, and at the back of the arc, respectively. Shield 400 is provided to prevent an infant from extending its arm into swing area A, where they might be pinched between swing arm 250 and support post 210 at the back of the arc, or otherwise interfere with the motion of the swing.

The shield 400 may be integrally coupled with seat 190 to prevent the removal of shield 400. Likewise, it would be undesirable to couple shield 400 to the removable seat portion 180. Shield 400 is preferably coupled in a taut configuration between swing arms 250 and seat 190 to prevent deformation of the shield 400 thereby allowing an infant to place their arm within the swing area A. The shield 400 can be manufactured from any material that provides the desired obstruction from the swing area A. In the illustrated embodiment, the shield 400 is manufactured from a mesh material that allows a parent to view the infant sitting in the seat 190 while still providing the desired protection.

As discussed above, the frame 105 is reconfigurable between a first, use position in which support posts 210 are angularly spaced from the base 105 and a second, storage or transportation position in which the support posts 210 are adjacent to base 105. The swing 100 is illustrated in the use position in FIGS. 1 through 7 and in the storage position in FIGS. 8 and 9. When the swing is in the use position, the base 105 is substantially horizontal along a ground surface, and the support posts 210 extend upwardly from the base 150 and the swing arms extended downwardly from the second ends 214 of the support posts 210.

The angular position between the base 150 and support post 210 is such that the swing arms 250 extend downwardly above the base 150 to maintain a stable configuration of the collapsible swing 100 when in the first position. When an infant is positioned in the seat, the center of gravity of the infant and the seat 190 together is directly below the pivot point of the swing arms 250. The pivot point of the swing arms 250 is situated between the front member 153 and the rear of the base 150. Moreover, the extent of the side members 152 of the base 150 is great enough to prevent the swing 100 from tipping when seat 190 is at the ends of the arc through which it moves. The support posts 210 each define an acute angle with respect to the base 150 when the swing 100 is in the use position, and therefore when the frame 105 is moved to the second position in which the support arms 210 are approximately parallel to, and on the opposite side of, the base, the base 150 rotates through an angle greater than 90 degrees.

Figure 10:
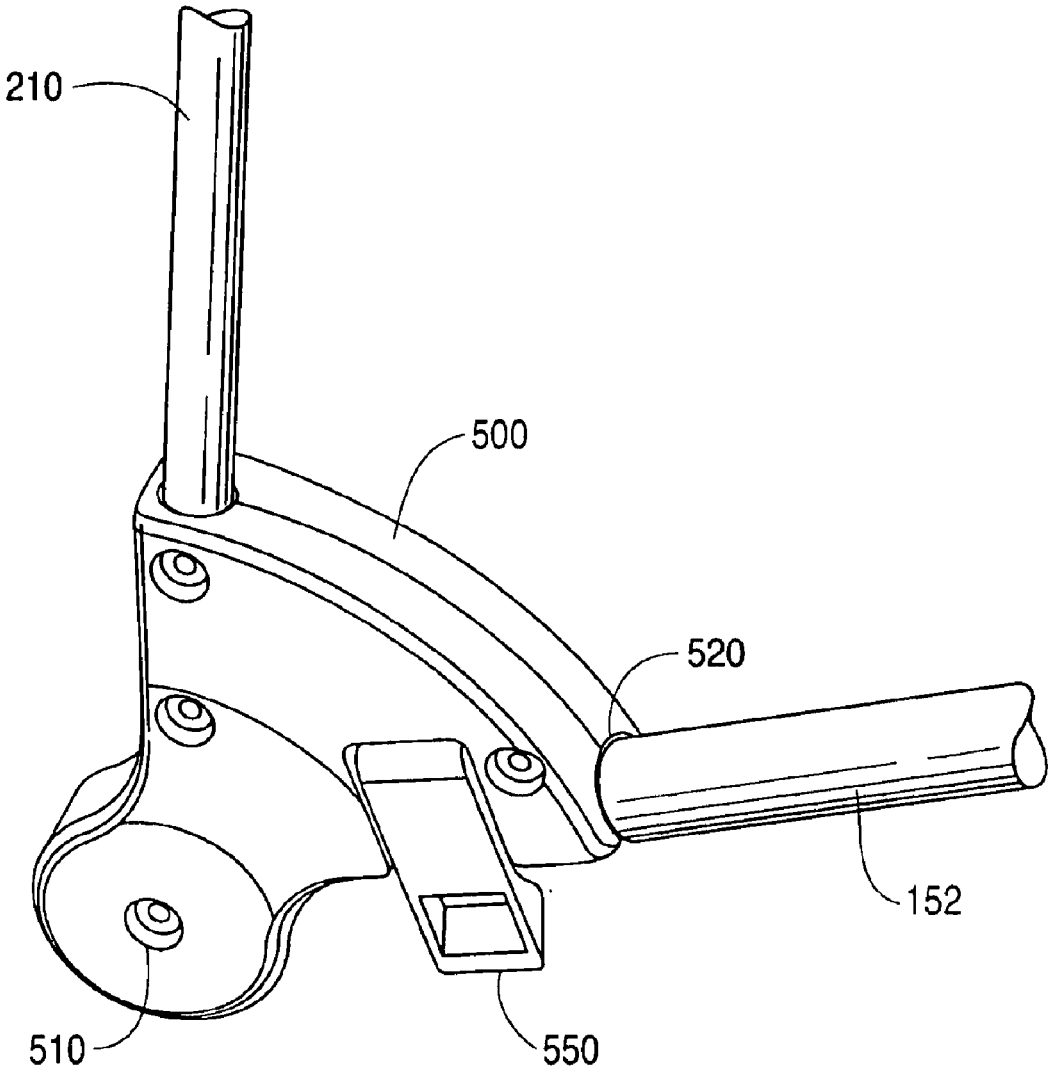
FIG. 10 is a perspective view of a first embodiment of a positioning member of the collapsible infant swing embodying the principles of the present invention.

To maintain the angular spacing between the support post 210 and the side member 152 in the use position, a positioning member 500 is provided. The base post 152 is pivotally coupled to positioning member 500 about pivot point 510. Support post 210 is fixed within a socket in positioning member 500 (as best seen in FIG. 10). Alternatively, both the support post 210 and the base post 152 could be pivotally coupled to positioning member 500. Positioning member 500 includes a semi-cylindrical groove 520 to nestingly receive base post 152 when the swing 100 is in the first position. A locking clip or retention member 550 is provided on positioning member 500 to maintain the base post within groove 520 when the frame 105 is in the first position. Side members 252 may be coupled to a rotatable hub 530 that is pivotally coupled to positioning member 500.

Figure 8:
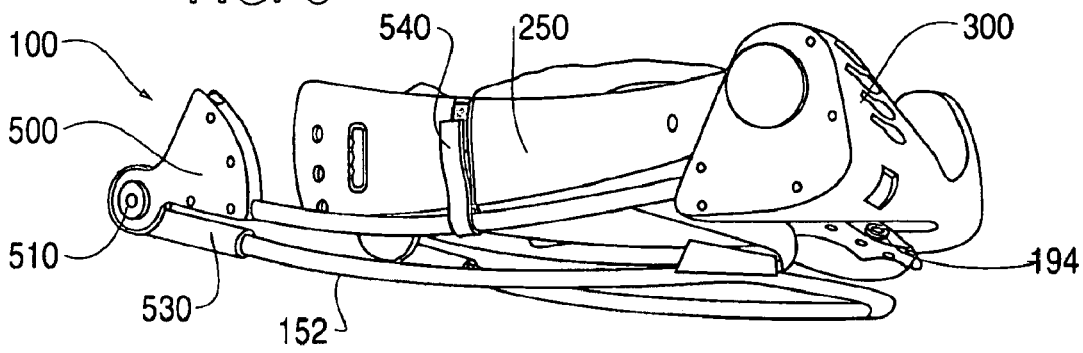
FIGS. 8 and 9 are side and front views of the collapsible infant swing illustrated in FIG. 1 in the collapsed configuration.
Figure 9:
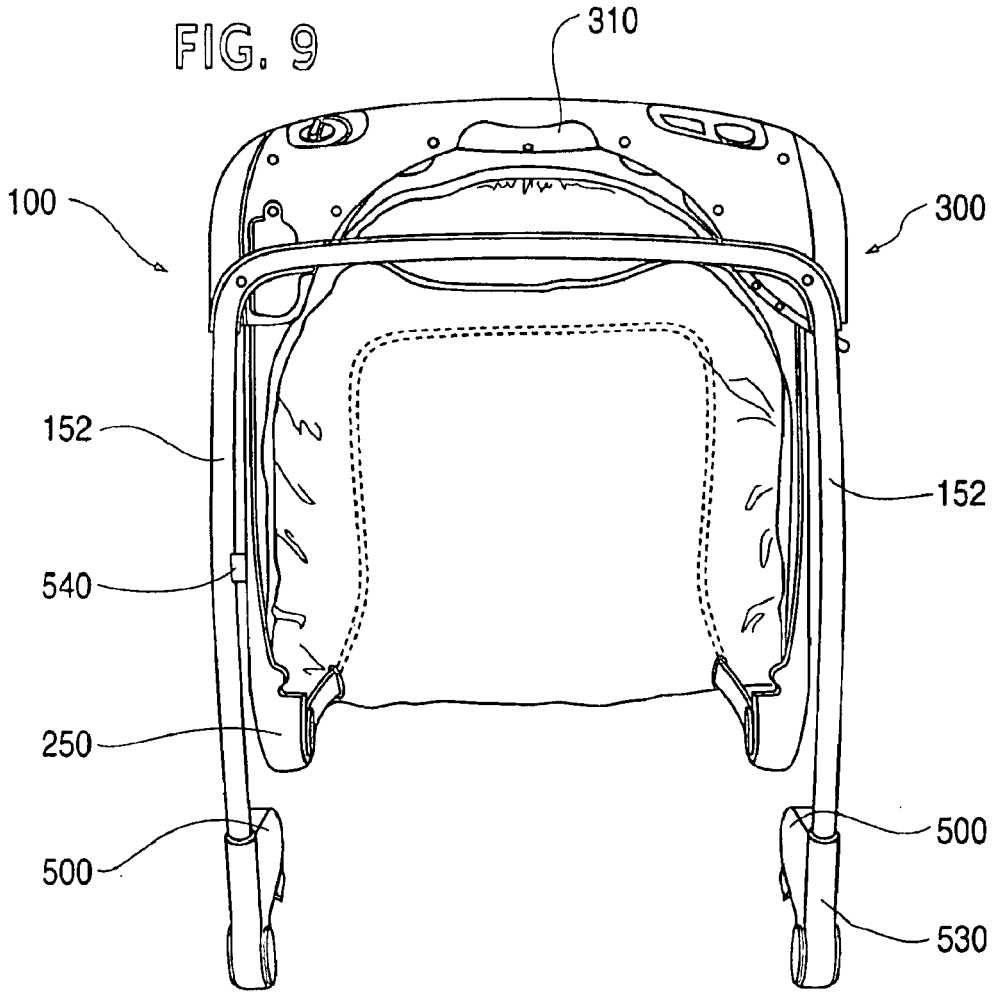

In use, a user can move the frame 105 from the first position to the second position illustrated in FIGS. 8 and 9 by releasing the locking clip/retention member 550 and pivoting the base 150 around pivot point 510 until the base 150 is adjacent the support posts 210. In the position illustrated in FIGS. 8 and 9, the portion of the base 150 that previously engaged the ground or support surface, is adjacent to the support post 210 as illustrated. As best seen in FIG. 9, at least a portion of the support posts lie in a common plane with a respective ground engaging base post in both the first position and the second position.

After folding the frame 105 into the second position, the user may fold the seat 190 such that the entire collapsible swing 100 is in a planar orientation as illustrated in FIG. 8. A detent mechanism is provided in positioning member 500 and cooperates with side member 152 to maintain the base 150 in the storage position. A strap 540 is coupled to the seat 190 and is long enough to wrap around the swing arm 250 to maintain the seat 190 in a folded orientation when the swing 100 is in the storage position.

Figure 11:
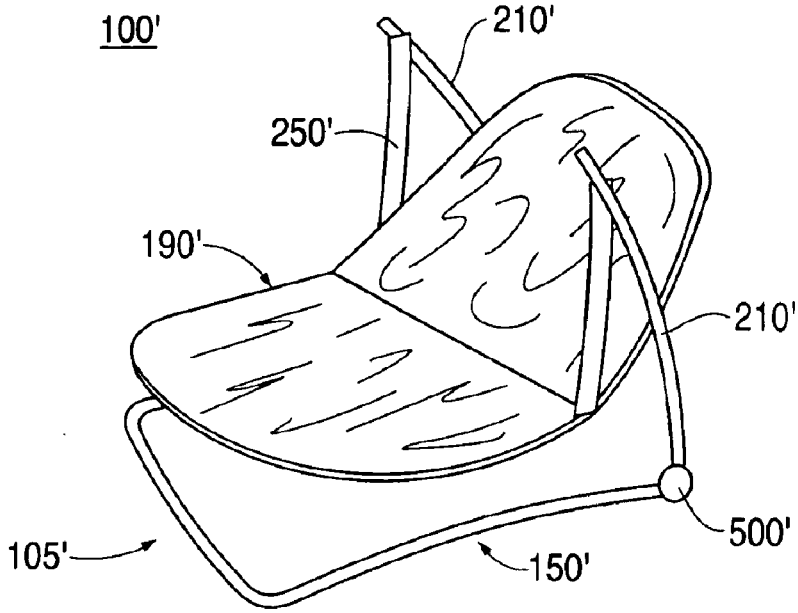
FIG. 11 is a perspective view of a second embodiment of a collapsible infant swing embodying the principles of the present invention.

While particular, illustrative embodiments of the invention have been described, numerous variations and modifications exist that would not depart from the scope of the invention. For example, as described above, a pair of swing arms 250 that are coupled to cross member 300 supports the seat 190 within the frame 105. In one alternative embodiment, illustrated in FIG. 11, swing 100' includes a pair of swing arms 250' that are pivotally coupled directly to support arms 210'. The base 150' is pivotally coupled around positioning member 500'.

Figure 12:
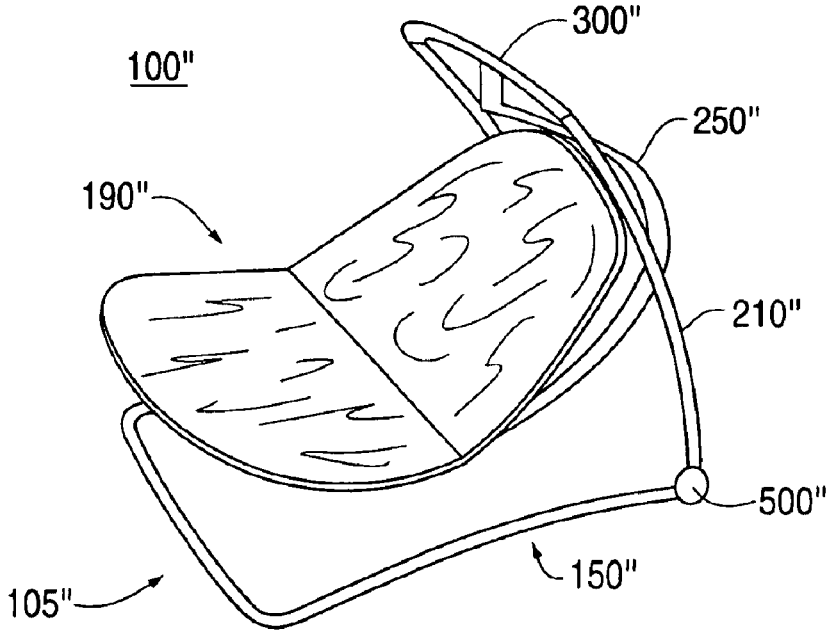
FIG. 12 is a perspective view of a third embodiment of a collapsible infant swing embodying the principles of the present invention.

In another alternative embodiment, illustrated in FIG. 12, swing 100" includes a single swing arm 250" that is pivotally coupled to cross member 300" such that seat 190" is supported within the frame 105" by a single pivot point. The configuration of swing arm 250" may be similar to the structure disclosed in U.S. Pat. Nos. 5,803,817 and 6,027,409, the disclosures of which are incorporated herein by reference in their entirety.

Figure 13:
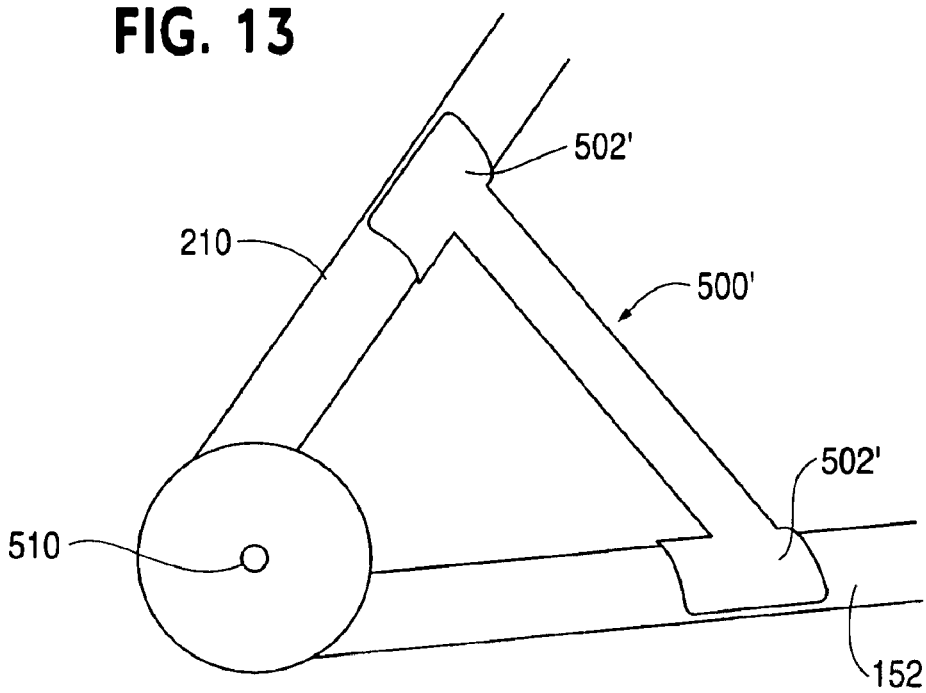
FIG. 13 is a second embodiment of a positioning member for use with the collapsible infant swing embodying the principles of the present invention.

The positioning member 500 as described above includes a wedge-shaped member disposed between the angle formed between the support posts 210 and the side posts 252 of the base 150 to maintain their relative positions when the frame 105 is in the first position. FIG. 13 illustrates an alternative embodiment of positioning member 500'. In that embodiment, positioning member 500' includes clips 502' that receive the support post 210 and base post 152 to maintain the support post and base post angularly spaced from one another when the frame 105 is in the first configuration. To reconfigure the frame 105 into the storage position, one or both clips 502' would be disengaged from support posts 210 and/or side members 152.

Figure 14:
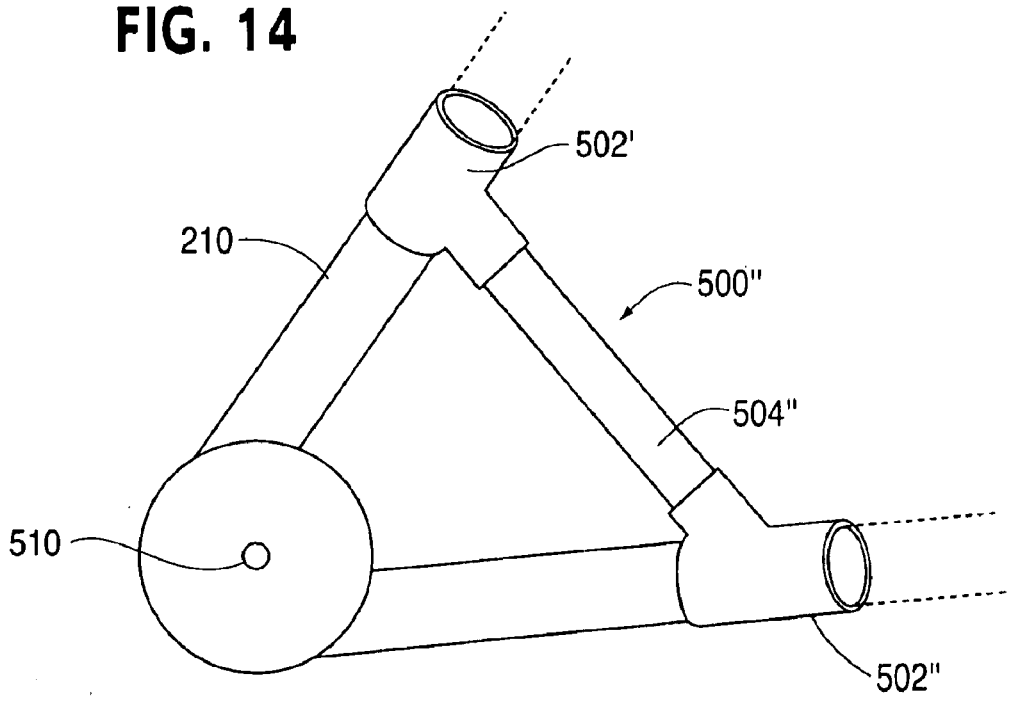
FIG. 14 is a third embodiment of a positioning member for use with the collapsible infant swing embodying the principles of the present invention.

FIG. 14 illustrates a further embodiment of a positioning member 500" in which the positioning member 500" includes two collars 502" that receive a post 504" to maintain the angular position between the support post 210" and the base post 150" when the frame 105 is in the first position. To reconfigure the frame 105 into the storage position, the post 504" would be disengaged from the collars 502".

Each of the illustrated embodiments disclose a positioning member 500, 500', 500" that acts under compressive force between the support post 210 and the base post 152. It will be appreciated that in a further alternative embodiment, positioning member 500 would be a tensile member, such as strap extending around the pivot point 510 and connected to the outer edges of support post 210 and base post 152 to maintain the frame in the use orientation.

As described above, the frame 100 is maintained in the storage position by using a detent mechanism. Alternatively, an arrangement of straps or clips could be utilized to maintain the position of the base 150 with respect to the support posts 210 in the storage position.

Also as described above, the seat 190 is provided with a strap 540 to maintain the seat 190 in a folded orientation when the swing 100 is in the storage position. Alternatively, multiple straps may be used or an arrangement of fasteners such as hook-and-loop fasteners, snaps, etc. may be provided on opposing seat surfaces to secure the seat in a folded orientation when the swing is in the storage position.

CONCLUSION

While various embodiments of the present invention have been described above, it should be understood that they have been presented by way of example only, and not limitation. Thus, the breadth and scope of the present invention should not be limited by any of the above-described exemplary embodiments, but should be defined only in accordance with the following claims and their equivalents.

The previous description of the preferred embodiments is provided to enable any person skilled in the art to make or use the present invention. While the invention has been particularly shown and described with reference to preferred embodiments thereof, it will be understood by those skilled in the art that various changes in form and details may be made therein without departing from the spirit and scope of the invention.

What is claimed is:

1. An infant swing, comprising:

a support frame;

a swing arm extending downwardly from, and pivotably coupled to, said support frame;

a seat coupled to said swing arm, the seat being configured to move between an expanded configuration and a collapsed configuration; and a flexible fabric shield coupled to said swing arm, extending downwardly toward said seat, and disposed to prevent an infant occupant of said seat from extending its arm beyond said swing arm, the flexible fabric shield being taut when the seat is in the expanded configuration and being loose when the seat is in the collapsed configuration.

2. The infant swing of claim 1, wherein said support frame is configured to move between a collapsed configuration and an expanded configuration.

3. A collapsible infant swing, comprising:

a support frame reconfigurable between a first, use position and a second, storage position;

a swing arm pivotably coupled to said support frame;

a seat coupled to said swing arm and having a foot portion and a back portion, the foot portion and the back portion each being pivotably coupled to said swing arm such that said seat is movable between a first, use position and a second, storage position, the foot portion and the back portion being approximately parallel in the storage position; and a shield coupled to said swing arm between said seat and said support frame.

4. The infant support of claim 3, said support frame including a first portion and a second portion pivotably coupled to said first portion, wherein said first portion is angularly spaced from said second portion in said use position and said first portion is adjacent said second portion in said storage position.

5. An infant swing, comprising:

a first frame portion;

a second frame portion pivotably coupled to said first frame portion, said first frame portion and said second frame portion being reconfigurable between a first position in which said second frame portion is angularly spaced from said first frame portion and a second position in which said first frame portion is adjacent said second frame portion;

a cross member coupled to at least said first frame portion;

first and second swing arms, each said swing arm having a first end and a second end, each of said second ends of said swing arms being pivotably coupled to said cross member and extending downwardly from said first frame portion when in said first position;

a seat coupled to said first ends of said swing arms, said seat being reconfigurable between a use position and a storage position; and a shield coupled to said swing arm between said seat and said first frame portion.

6. The infant swing of claim 5, further comprising:

selectively actuatable output including at least one of lights and sounds, the lights and sounds being output from an output generator coupled to the cross member.

* * * * *